United States Patent [19]

Mino

[11] 4,225,096

[45] Sep. 30, 1980

[54] GROOVED TRAVERSE DRUM FOR USE IN DRUM WINDER

[75] Inventor: Masao Mino, Yao, Japan

[73] Assignee: Kabushiki Kaisha Mino Seisakusho, Osaka, Japan

[21] Appl. No.: 45,836

[22] Filed: Jun. 5, 1979

[30] Foreign Application Priority Data

Jul. 3, 1978 [JP] Japan ..... 53-81345

[51] Int. Cl.[3] ..... B65H 54/48

[52] U.S. Cl. ..... 242/43.2

[58] Field of Search ..... 242/43.2

[56] References Cited

U.S. PATENT DOCUMENTS 4,036,447 7/1977 Mino ..... 242/43.2

*Primary Examiner*—Stanley N. Gilreath

*Attorney, Agent, or Firm*—Armstrong, Nikaido, Marmelstein & Kubovcik

[57] ABSTRACT

A grooved traverse drum for use in a drum winder having an abrasion-resistant member inserted and fixed therein at each crossover point of the yarn guide groove. The abrasion-resistant member has a recess which forms the bottom and opposite side walls of the yarn guide groove at each crossover point. The yarn travel guide surface of the recess, except a very small portion thereof, is formed to be slightly higher than the groove-forming surface of the drum constituting material.

3 Claims, 5 Drawing Figures

GROOVED TRAVERSE DRUM FOR USE IN DRUM WINDER

BACKGROUND OF THE INVENTION (a) Field of the Invention

The present invention relates to a grooved traverse drum for use in a drum winder for winding parallel cheeses or cone cheeses.

(b) Description of the Prior Art

It is known in the art that the grooved traverse drum (hereinafter referred to simply as the drum) is subject to abrasion, though small in amount, at different places in the yarn guide groove, especially at the crossover points, owing to the frequent repetition of friction between the drum and the yarn being wound, said abrasion forming a cause of yarn breaks and hence deterioration in yarn quality.

In an effort to prevent such abrasion, there have been proposed methods which use abrasion-resistant members to be inserted and fixed in the yarn guide groove at the crossover points thereof where the abrasion is particularly severe.

For example, there has been proposed a method wherein an abrasion-resistant member provided on its peripheral surface with a recess which forms a yarn guide groove bottom is inserted and fixed in a traverse drum composed of an outer sleeve of stainless steel and an inner sleeve of porcelain at each crossover point thereof.

According to this method, however, a recess for receiving the abrasion-resistant member must be provided on the boundary between the outer sleeve of stainless steel and the inner sleeve of porcelain and the dimensional accuracy of said recess tends to be so poor as to create a clearance in said boundary. Therefore, careful processing is required in order to reduce said clearance, involving high cost. Further, even if the boundary is filled with an adhesive agent, it will wear out soon, creating a clearance.

I have already proposed a method wherein a cylindrical abrasion-resistant member having a yarn guide groove bottom and side walls is inserted and fixed at each crossover point of the yarn guide groove of a drum made of a single drum constituting material.

According to the above-mentioned method, however, if the yarn guide groove at the crossover points is deep, the boundary portion between the abrasion-resistant member which contacts the yarn and the drum constituting material is remote from the drum surface and located near a narrow groove bottom portion, thus making it difficult to process the groove forming surface of the abrasion-resistant member and the groove forming surface of the drum constituting material in such a manner as to make them flush with each other, thus having a disadvantage that the cost of production of the drum is high,

SUMMARY OF THE INVENTION

Objects of the present invention are to eliminate the disadvantages inherent in the prior art; to provide a drum having no clearance in the boundary between the drum constituting material and the abrasion-resistant member and capable of winding even thin cotton yarns of NE $100^s$ and $120^s$ (British count) at high speed: and to provide a drum at low price by greatly reducing the cost.

More particularly, the invention is based on the findings; that when a yarn guided in the yarn guide groove passes the boundary between the groove forming surface of the drum constituting material and the groove forming surface of the abrasion-resistant member, the positions causing the problems of yarn napping and yarn breakage due to differences in plane and abrasion are a boundary portion which the yarn first contacts when it travels from the groove forming surface of the drum constituting material to the groove forming surface of the abrasion-resistant member, and a boundary portion which the yarn last contacts when the yarn, having passed said first portion and completed its crossing over as guided by the groove forming surface bottom of the abrasion-resistant member, travels from the groove forming surface of the abrasion-resistant member to the groove forming surface of the drum constituting material; and that these boundary portions are small portions close to the drum surface. Thus, according to the invention, the boundary portions causing the problems of yarn napping and yarn breakage are reduced to as small areas as possible (for example, semicircles) and located as close to the drum surface as possible, the groove forming surface of the drum constituting material being below the level of the yarn travel surface so that at the other boundary portions the yarn will contact the abrasion-resistant member but will not contact the drum constituting material. In this case, the abrasion-resistant members are inserted from the opposite ends of the drum axially of the drum and fixed therein, eliminating the danger of the abrasion-resistant members being thrown out during use.

The opposite ends of said drum are formed with recesses for receiving the abrasion-resistant members, said recesses being of the same shape and same size as the abrasion-resistant members and extending axially of the drum to cross the groove bottom and opposite side walls of the yarn guide groove crossover points at the opposite ends of the drum.

The abrasion-resistant members each have approximately rectangular end surfaces, two opposed sides of such rectangle being semicircular. Such members are produced by cutting a long material of uniform cross-section into predetermined lengths or are produced one by one by a suitable molding process. Each abrasion-resistant member has on a portion of its peripheral surface a recess forming the yarn guide side walls and bottom of the associated yarn guide groove crossover point and has a clearance adjusting groove on the side of its peripheral surface opposite to said recess. The abrasion-resistant members, with an adhesive agent applied thereto, are inserted in said reception recesses and then clearance adjusting pins are driven into said clearance adjusting grooves to push up the abrasion-resistant members toward the drum surface to eliminate the clearances in the boundary portions near the drum surface which are liable to cause the problems of yarn napping and yarn breakage.

Therefore, according to the invention, it is possible to provide a drum which is capable of winding even thin yarns of NE $100^s$ and $120^s$ at high speed.

Further, according to the invention, the boundary portions causing the problems of yarn nappling and yarn breakage are semicircles of about 2 mm in diameter to reduce the area of first contact with the yarn and the area of last contact with the yarn after crossing over, whereby the time required for processing the boundary portions to make them flush with each other can be reduced.

Further, by locating said boundary portions about 2 mm away from the drum surface toward the drum center, the processing for making the groove forming surface of the drum constituting material and the groove forming surface of the abrasion-resistant material flush with each other is simplified and the processing time is reduced. Since in the regions other than said boundary portions the groove forming surface of the drum constituting material is located below the level of the yarn travel surface in order for the yarn not to contact the drum constituting surface, said regions do not require the processing for making flush. As a result, the processing time can be reduced, achieving a great reduction in cost and making it possible to provide a drum at low price.

The invention achieves a great reduction in cost particularly when the groove of the yarn guide groove crossover point is deep.

DESCRIPTION OF THE PREFERRED EMBODIMENT

Figure 1:
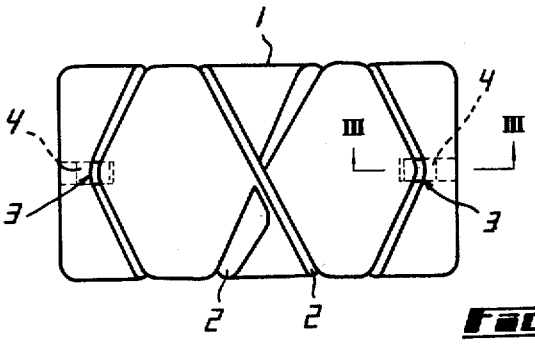
FIG. 1 is an external view of a grooved traverse drum with the present invention applied thereto.

FIG. 1 is a plan view of a grooved traverse drum for use in a drum winder with the invention applied thereto. The numeral 1 designates a drum collectively; 2 designates a yarn guide groove spirally formed in the drum on its peripheral surface; and 3 designates yarn guide groove crossover points on the drum surface at the opposite ends.

Figure 2:
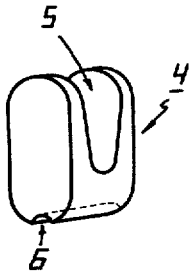
FIG. 2 is an external perspective view showning an example of an abrasion-resistant member according to the invention.
Figure 3:
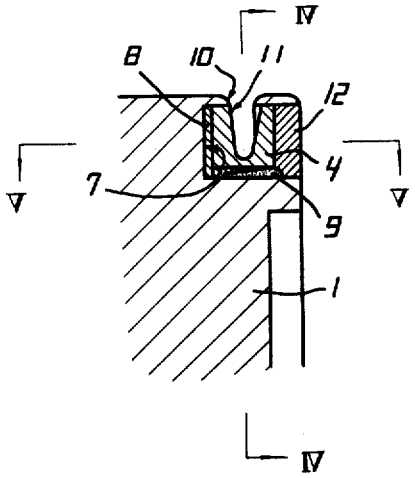
FIG. 3 is a section taken along the line III—III of FIG. 1.

FIG. 2 is an external perspective view showing an example of an abrasion-resistant member according to the invention. The numeral 4 designates a body; 5 designates a recess formed therein on a portion of its peripheral surface; and 6 designates a clearance adjusting groove.

As shown in FIG. 1, the abrasion-resistant members 4 are inserted in regions corresponding to the yarn guide groove crossover points 3 on the peripheral surface of the drum 1 at its opposite ends, and are fixed therein.

The opposite ends of the drum 1 to receive said abrasion-resistant members 4 are formed with reception recesses 7. The abrasion-resistant members 4, with a suitable adhesive agent 8 applied thereto, are inserted into said recesses and clearance adjusting pins 9 are then driven in so as to lift the abrasion-resistant members to bring their guide surfaces 11 into alignment with the guide surface 10 of the drum 1 so that there is no difference in plane. Thereafter, an adhesive filler 12 is charged. In this way, all clearances are eliminated.

The clearance adjusting pins 9 may be extracted after the fixing of the abrasion-resistant members 4 in the reception recesses 7 of the drum 1 has stabilized to some extent.

Figure 4:
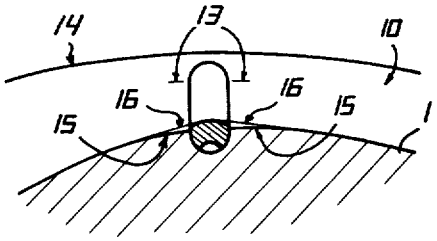
FIGS. 4 and 5 are sections taken along the lines IV—IV and V—V of FIG. 3, respectively.

Further, as shown in FIG. 4, a boundary portion 13 which is liable to cause the problems of yarn napping and yarn breakage is as small a semicircle as possible and is located as close as possible to the surface 14 of the drum 1. Moreover, at said boundary 13, the abrasion-resistant member 4 is aligned with the yarn guide surface 10 of the drum constituting material so that there is no difference in plane and that at the other boundary portions than said boundary portion 13, the yarn will contact the abrasion-resistant member 4 but will not contact the drum constituting material. As a result, the boundary portions which require finishing can be limited to a small range and can be only those places which are close to the drum surface.

Thus, at the boundary portion which is located on the groove bottom, as shown in FIG. 4, the groove bottom surface 15 is positioned, for example, about 0.5 to 1 mm below the yarn travel surface 16. As a result, at said boundary portion, no finishing is needed.

Figure 5:
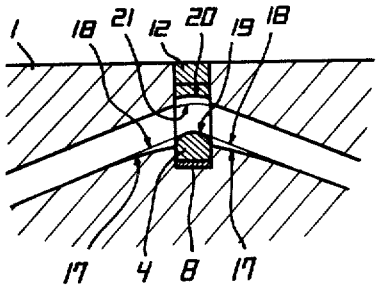

Further, at the boundary portion located at a side wall portion, as shown in FIG. 5 the wall surface 17 of the drum constituting material is positioned, for example, about 0.5 to 1 mm below the yarn travel surface 18. As a result, at said boundary portion, no finishing is needed.

Referring to FIG. 5, the side surface 20 opposed to the yarn guide surface 19 of the abrasion-resistant member is also positioned, for example, about 0.5 to 1 mm below the side surface 21 of the drum constituting material at the boundary portion. As a result, at said boundary portion, no finishing is needed.

The above embodiment is illustrative of the invention only, not limiting the same.

As has been described so far, the invention provides a grooved traverse drum for use in a drum winder having a spiral yarn guide groove on its peripheral surface, characterized in that an abrasion-resistant member having a recess forming the groove bottom and side walls of the yarn guide crossover point at each end of the drum is inserted in the drum from each end thereof and fixed therein and in that, of the boundary between the groove forming surface of said abrasion-resistant member and the groove forming surface of the drum constituting material, the portion which the yarn will first contact and the portion which the yarn, after crossing over, will last contact are positioned as close to the drum surface as possible and are flush with each other to have no difference in plane and no clearance and as small in area as possible, while at the other portions the groove forming surface of the drum constituting material is below the level of the yarn travel surface and the yarn is guided as it contacts the groove forming surface of the abrasion-resistant member. Therefore, it is possible to eliminate the clearance in the boundary which is liable to cause the problems of yarn napping and yarn breakage, making it possible to wind even thin yarns of NE $100^s$ and $120^s$. Further, it is possible to achieve a great reduction in cost as compared with the conventional drums, thus offering a drum at low price.

What is claimed is:

1. A grooved traverse drum construction comprising a cylindrical drum body and a plurality of abrasion-resistant members, said drum body having a spiral yarn guide groove formed in the peripheral surface of the cylindrical drum body, said yarn guide groove having a traverse end at each end of the drum body, with each traverse end having a bottom, an axially inward lateral side wall, and an opposed spaced outward lateral side wall, said inward wall having an upper portion near the drum surface, said drum body having apertures extending into each end and intersecting the bottom of the lateral side walls of each traverse end of the yarn guide groove, said abrasion-resistant members being inserted in the apertures, each abrasion-resistant member comprising a body portion and a recess portion having oppositely spaced side walls and a bottom groove portion centrally positioned in said body portion, a portion of one of said recess portion side walls being flush with said upper portion of said inward side wall of said traverse end of said yarn guide groove, and the remaining portion of said one of said recess portion side walls and said bottom groove portion extending away from said inward side wall and said bottom of said traverse end, respectively.

2. A construction as set forth in claim 1 wherein each abrasion-resistant member further comprises a clearance adjusting groove in said body portion located oppositely to the bottom groove portion and the construction further comprises tapered clearance adjusting pins fitted into each adjusting groove to position said one of said recess portion side walls flush with said upper portion of said inward side wall of said traverse end of said yarn guide groove.

3. A grooved traverse drum for use in a drum winder as set forth in either claim 1 or 2, wherein the abrasion-resistant member has approximately rectangular end surfaces, the two shorter sides of the rectangle being semicircular, said member having a uniform cross-section extending axially of the drum, and said member has a recess located approximately at the middle axially of the drum and a clearance adjusting groove on its peripheral surface on the side opposite to said recess.

* * * * *